US010759510B2

(12) United States Patent
Bartnik et al.

(10) Patent No.: US 10,759,510 B2
(45) Date of Patent: Sep. 1, 2020

(54) METHOD OF ARRANGING THE LUBRICATION OF A CONTROLLABLE PITCH PROPELLER ARRANGEMENT OF A MARINE VESSEL AND A LUBRICATION ARRANGEMENT THEREFOR

(71) Applicant: WÄRTSILÄ NETHERLANDS B.V., DM Drunen (NL)

(72) Inventors: Lukasz Bartnik, Rubbestadneset (NO); Robert Vogels, DM Drunen (NL)

(73) Assignee: WÄRTSILÄ NETHERLANDS B.V., DM Drunen (NL)

( * ) Notice: Subject to any disclaimer, the term of this patent is extended or adjusted under 35 U.S.C. 154(b) by 497 days.

(21) Appl. No.: 15/548,920

(22) PCT Filed: Mar. 5, 2015

(86) PCT No.: PCT/EP2015/054632
§ 371 (c)(1),
(2) Date: Aug. 4, 2017

(87) PCT Pub. No.: WO2016/138960
PCT Pub. Date: Sep. 9, 2016

(65) Prior Publication Data

US 2018/0029680 A1 Feb. 1, 2018

(51) Int. Cl.
*B63H 3/08* (2006.01)
*F15B 15/14* (2006.01)

(52) U.S. Cl.
CPC ..... *B63H 3/082* (2013.01); *B63H 2003/084* (2013.01); *F15B 15/149* (2013.01)

(58) Field of Classification Search
CPC . B63H 3/06; B63H 3/08; B63H 3/081; B63H 3/082; B63H 20/002; B63H 21/38;
(Continued)

(56) References Cited

U.S. PATENT DOCUMENTS 2,355,039 A * 8/1944 Eves ..... B63H 3/08 416/157 R
4,028,004 A 6/1977 Wind
(Continued)

OTHER PUBLICATIONS

International Search Report (PCT/ISA/210) dated Dec. 4, 2015, by the European Patent Office as the International Searching Authority for International Application No. PCT/EP2015/054632.
(Continued)

*Primary Examiner* — David E Sosnowski
*Assistant Examiner* — Danielle M. Christensen
(74) *Attorney, Agent, or Firm* — Buchanan Ingersoll & Rooney PC

(57) ABSTRACT

The present disclosure discusses a method of and an arrangement for the lubrication of a controllable pitch propeller of a marine vessel. The lubrication is based on continuous lubricant circulation from the hydraulic powerpack to the hub and back to the oil tank, when the marine vessel is sailing ahead with propeller blades locked in a desired position. The lubrication is performed by maintaining, at least when the propeller blades are locked in a desired position, a pressure difference between the astern oil chamber and the lubricant chamber for circulating lubricant from the astern oil chamber via the lubricant chamber to the oil tank.

22 Claims, 7 Drawing Sheets

(58) Field of Classification Search
CPC ..... B63H 21/386; B63H 2003/084; F15B 15/149; F01D 25/18; F01D 25/20
USPC ..... 416/93 A, 245 A, 244 B, 146 A, 174
See application file for complete search history.

(56) References Cited

U.S. PATENT DOCUMENTS 4,863,347 A * 9/1989 Trott ..... B64C 11/38 416/46
6,042,337 A 3/2000 Thyberg

OTHER PUBLICATIONS

Written Opinion (PCT/ISA/237) dated Dec. 4, 2015, by the European Patent Office as the International Searching Authority for International Application No. PCT/EP2015/054632.
International Preliminary Report on Patentability (PCT/IPEA/409) dated Jun. 29, 2016, by the European Patent Office as the International Searching Authority for International Application No. PCT/EP2015/054632.

* cited by examiner

METHOD OF ARRANGING THE LUBRICATION OF A CONTROLLABLE PITCH PROPELLER ARRANGEMENT OF A MARINE VESSEL AND A LUBRICATION ARRANGEMENT THEREFOR

TECHNICAL FIELD

The present invention relates to a novel method of arranging the lubrication of a controllable pitch propeller of a marine vessel and a lubrication arrangement therefor. More closely the present invention relates to the method in accordance with the preamble of claim 1 and to the lubrication arrangement in accordance with the preamble of claim 14.

BACKGROUND ART

Controllable pitch propellers are becoming more and more popular in marine vessels. The pitch control gives the operator a chance to alter the speed of the marine vessel by changing the blade angle or pitch of the propeller, and more importantly, to change the direction of movement of the marine vessel by turning the propeller blades from ahead direction to astern direction, whereby there is no need to provide the vessel with such a gearbox that is capable of changing the rotational direction of the propeller, or need to reverse the rotational direction of the engine. Such controllable pitch propellers are arranged in a so-called hub. The marine vessel propulsion arrangement comprises an engine, a drive means, a drive shaft and the hub with the propeller blades. The drive means is normally a reduction gear or an electric drive motor, which is used to drive the drive shaft. The pitch of the propeller is controlled by means for turning the propeller blades. The propeller blade turning means comprise actual mechanical turning arrangement arranged in the hub, and means for actuating the mechanical turning arrangement. The mechanical turning arrangement comprises a crank ring for each propeller blade. The propeller blade is rotatably coupled and sealed to the body or casing of the hub by means of the crank ring. The crank ring has a non-central or non-concentric pin extending towards the inside of the hub. The pin is fitted in a groove provided on a member arranged concentrically in the hub body and moving in the direction of the axis of the propeller. The groove extends, preferably, in a direction perpendicular to the axis of the propeller. Now that the moving member is shifted in axial direction by means of the actuating means, the crank ring/s and the propeller blade/s are forced to turn, whereby the pitch of the propeller blades is controlled.

There are basically two types of actuating means, i.e. a mechanical one and a hydraulic one. The mechanical one comprises a rod extending along a central bore in the drive shaft from the drive means to the inside of the hub such that the rod is coupled inside the hub to the movable member, and at the drive means end of the drive shaft to means for moving the rod axially. With regard to the hydraulic actuating means, of which U.S. Pat. No. 4,028,004 may be presented as an example, the movable member inside the hub is arranged to work as a piston in a hydraulic cylinder. In other words, on both axial sides of the movable member there are chambers, so called astern chamber and ahead chamber, into either one of which, when pitch control is desired, pressurized oil is delivered depending on the direction the propeller blades are to be turned. If the pressurized oil is taken to the ahead chamber, the piston, i.e. the movable member, turns the propeller blades such that the propeller blades move the marine vessel in ahead direction. And if the pressurized oil is taken to the astern chamber, the piston, i.e. the movable member, turns the propeller blades such that the propeller blades move the marine vessel in astern direction. Naturally, in the intermediate positions of the piston, the propulsive force of the propeller is reduced due to reduced pitch of the propeller blades.

The pressurized oil is taken to the astern and ahead oil chambers via a central bore in the drive shaft and by providing the central bore with a concentric tube such that two separate oil passages are formed. The oil is provided in the oil passages by means of an oil distribution box arranged in connection with the drive means, i.e. the purpose of the oil distribution box is to deliver oil from stationary oil pipes to rotary oil passages in the dive shaft. The oil distribution box receives pressurized oil from a so called hydraulic powerpack such that the operator of the marine vessel controls, by means of a pilot-operated main control valve arrangement, into which oil passage the pressurized oil is directed, whereby the other oil passage acts as a return passage returning the oil to the hydraulic powerpack. In other words, the hydraulic powerpack receives oil from an oil tank, pressurizes the oil to a required pressure, and by means of the above mentioned pilot-operated main control valve arrangement delivers the pressurized oil to the desired application.

The propeller pitch control works normally such that when starting to move the marine vessel in ahead direction the operator moves the pilot-operated main control valve in the ahead position whereby pressurized oil is allowed to enter the ahead oil chamber in the hub and the oil in the astern oil chamber is allowed to escape the astern oil chamber so that the movable member may turn the propeller blades in ahead direction against the hydraulic pressure water subjects to the rotary propeller blades. When the propeller blades are in their desired position the pilot-operated main control valve is moved in a position blocking the flow in both oil passages, whereby the blades are maintained in their position by keeping the ahead oil path blocked and the blades creating a certain pressure in the ahead oil path. If no leakage would occur in any part of the piping, the propeller blades would be locked in their current position.

However, keeping the ahead flow path closed by means of the pilot-operated main control valve is not, in practice, possible, as, in the oil distribution box the oil flows from stationary oil pipes to rotary oil pipes, causing a significant leakage due to the nature of this type of seal (annular pressure seal). An option to solve this leakage-related problem would be to move the pilot-operated main control valve to compensate for this leakage, but this would be very energy inefficient and difficult to control. Therefore a blocking valve (pilot-operated non-return valve or similar), not discussed in the above-mentioned U.S. Pat. No. 4,028,004, is placed in the ahead rotary oil pipe. In the ahead rotary pipe because propellers are normally designed such that the blades turn automatically to their astern direction even if no pressure is introduced in the astern oil chamber. Oil flow from the ahead oil chamber to the pilot-operated main control valve is blocked (leakage of the blocking valve is minimal and can be considered insignificant with respect to keeping the propeller blades at their current position) and, in fact, to the oil distribution box, whereby the oil is pressurized between the piston and the blocking valve in the ahead oil path, effectively locking the propeller blades in their current position without any need of supplying additional pressurized oil from the hydraulic powerpack.

The blocking valve functions such that pressurized oil flowing from the pilot-operated main control valve towards the ahead oil chamber may pass the blocking valve, so as to be able to change the blade pitch towards ahead. The blocking valve is connected by means of a pilot line to the astern flow path such that pressurized oil flowing from the pilot-operated main control valve towards the astern oil chamber, when exceeding a certain pressure (determined among others by the pilot ratio of the blocking valve), is able to open the blocking valve thereby allowing oil to escape from the ahead oil chamber and therefore to allow the pitch of the blades to be changed to astern. Allowing pressurized oil to flow towards the astern oil chamber will cause the movable member to eventually be stopped by a mechanical stopper. In other words, when the propeller blades are in their "full astern" position the mechanical stopper will lock the propeller blades in their current position, not the blocked oil in either one of the oil chambers.

In addition to the hydraulic actuating means the hub needs oil for the lubrication of the mechanical turning or control arrangement. There are in fact two options for arranging the lubrication. A first one would be to supply oil to and from the hub through the stern tube. But, however, it is not a preferred option, as it would connect the hub lubrication system with the stern tube lubrication system, whereby a problem, for instance water ingress, in one system would result in the same problem in the other system, too. A second, preferred, option, discussed in the above-mentioned U.S. Pat. No. 4,028,004, too, is to use the central bore of the shaft as the safe route for the lubricant delivery into the hub. Therefore, the central bore of the drive shaft is provided with another concentric tube so that three separate flow passages are arranged within the drive shaft. The two innermost flow passages communicate with the astern and ahead oil chambers whereas the outermost flow passage between the moving member and the body or housing of the hub communicates the lubricant chamber.

The lubricant chamber is provided with oil from the oil tank by gravity. The oil tank is arranged above the waterline of a fully loaded marine vessel for safety purposes such that the hydrostatic pressure inside the hub remains always higher than the water pressure outside the hub, whereby in case of sealing failure in the hub water is not able to enter the lubricant chamber, but the lubricant leaks to the surrounding water.

However, practice has shown that water may enter the inside of the hub, i.e. to the lubricant chamber, by condensation, by leakage, or for some other reason. Thus, it was, at some point of time, considered that some kind of lubricant circulation is needed in place of the earlier practice, discussed in the above-mentioned U.S. Pat. No. 4,028,004, where the same lubricant remained in the lubricant chamber and collected water and any other impurities until specific measures were taken to replace the used lubricant with fresh one.

Naturally, the first suggestion was to arrange a third concentric tube in the central bore of the drive shaft, which would have required also changes in the oil distribution box. As such a construction was considered quite complicated and risky, it was, for the second suggestion, realized that the hub already has pressurized oil in their ahead and astern oil chambers at least while the pitch of the propeller was changed. To take this suggestion into use only meant that an oil flow channel should be arranged from one of the ahead and astern oil chambers to the lubricant chamber. Since such an oil flow channel is a static element without any need for repair or maintenance it was taken into use between the astern oil chamber and the lubricant chamber. The arranging of the lubricant channel to start from the ahead oil chamber is not possible as the ahead oil chamber has to be kept blocked and pressurized when sailing ahead. Naturally, the oil flow channel, as well as the lubricant circulation, was in use only when moving the propeller blades to their astern position, i.e. the oil circulation took place only occasionally for a substantially short period of time. However, at that time it was considered sufficient as the mineral oil that was used for both the hydraulics and lubricating the mechanical turning arrangement was capable of dealing with certain amount of water without damage to either the oil itself or the surfaces it was supposed to lubricate.

However, now the environmental requirements are about to change such that in all positions where there is even a minor risk of leakage of oil to the surrounding water such oil has to be used that degrades easily when in contact with water. This is, naturally, a good property for oil in view of environment, but not so desirable in view of lubrication, as such an environmentally acceptable lubricant has to be watched continuously, as it may lose its lubrication capability in days or weeks depending on the amount of water that has got into contact with the oil. Therefore, modern controllable pitch propellers have to be provided with an oil circulation, at least when sailing ahead, to ensure that water is not able to collect into the hub.

BRIEF SUMMARY OF THE INVENTION

A first object of the present invention is to offer a solution to one or more of the above discussed problems.

A second object of the present invention is to suggest an almost continuous circulation of lubricant for the lubrication of a controllable pitch propeller.

A third object of the present invention is to offer a simple and reliable arrangement for circulating the lubricant in the hub of a controllable pitch propeller.

A fourth object of the present invention is to offer a simple solution for making it possible to use environmentally acceptable lubricants in connection with controllable pitch propellers.

At least one of the above and other objects of the invention are met by a method of arranging the lubrication of a controllable pitch propeller arrangement of a marine vessel, the controllable pitch propeller arrangement comprising a hub, a drive shaft, a drive means, an oil distribution box, a hydraulic powerpack and an oil tank; the hub having a number of propeller blades and mechanical and hydraulic means for controlling the pitch of the propeller blades; the mechanical control means being arranged in a lubricant chamber; the hydraulic control means comprising an astern oil chamber and an ahead oil chamber; the hub being attached to a first end of a drive shaft; the second end of the drive shaft being coupled to the drive means; the drive shaft having three oil paths, an astern flow path for connecting the astern oil chamber to the hydraulic powerpack via the oil distribution box and an oil pipe, an ahead flow path for connecting the ahead oil chamber to the hydraulic powerpack via the oil distribution box and an oil pipe and a lubricant path for connecting the lubricant chamber to the oil tank via the oil distribution box and an oil pipe, the method comprising the steps of connecting the astern oil chamber by means of at least one oil circulation channel to the lubricant chamber and the lubricant chamber being connected by means of at least one first lubricant passage to the lubricant path, and arranging, at least when the propeller blades are locked in a desired position, a pressure difference between the astern oil chamber and the lubricant chamber for circulating lubricant from the astern oil chamber via the lubricant chamber to the oil tank.

At least one of the above and other objects of the invention are met by a lubrication arrangement for a controllable pitch propeller arrangement of a marine vessel, the controllable pitch propeller arrangement comprising a hub, a drive shaft, a drive means, an oil distribution box, a hydraulic powerpack and an oil tank; the hub having a number of propeller blades and mechanical and hydraulic means for controlling the pitch of the propeller blades; the mechanical control means being arranged in a lubricant chamber; the hydraulic control means comprising an astern oil chamber and an ahead oil chamber; the hub being attached to a first end of a drive shaft; the second end of the drive shaft being coupled to the drive means; the drive shaft having three oil paths, an astern flow path for connecting the astern oil chamber to the hydraulic powerpack via the oil distribution box and an oil pipe, an ahead flow path for connecting the ahead oil chamber to the hydraulic powerpack via the oil distribution box and an oil pipe and a lubricant path for connecting the lubricant chamber to the oil tank via the oil distribution box and an oil pipe; the astern oil chamber being connected by means of at least one oil circulation channel to the lubricant chamber and the lubricant chamber being connected by means of at least one first lubricant passage to the lubricant path, the arrangement further comprising the astern oil chamber connected by means of at least one oil circulation channel to the lubricant chamber and the lubricant chamber being connected by means of at least one first lubricant passage to the lubricant path, and a source of pressurized oil arranged, at least when the propeller blades are locked in a desired position, in flow communication with the astern oil chamber.

Other characteristic features of the present method of arranging the lubrication of a controllable pitch propeller of a marine vessel and a lubrication arrangement therefor become apparent from the description herein.

The present invention, when solving at least one of the above-mentioned problems, provides at least the following advantages

- continuous circulation of lubricant when sailing ahead with the propeller blades locked in a desired position,
- reliable lubrication of the controllable pitch propeller,
- cost-effective means for arranging the circulation of the lubricant,
- minimal changes in the present controllable pitch propellers,
- easy to update existing controllable pitch propellers to include the novel lubricant circulation, and
- use of environmentally acceptable, easily degradable lubricants in controllable pitch propellers.

BRIEF DESCRIPTION OF DRAWINGS

In the following, the novel method of arranging the lubrication of a controllable pitch propeller of a marine vessel and a lubrication arrangement therefor is explained in more detail with reference to the accompanying Figures, of which

DETAILED DESCRIPTION OF DRAWINGS

Figure 1:
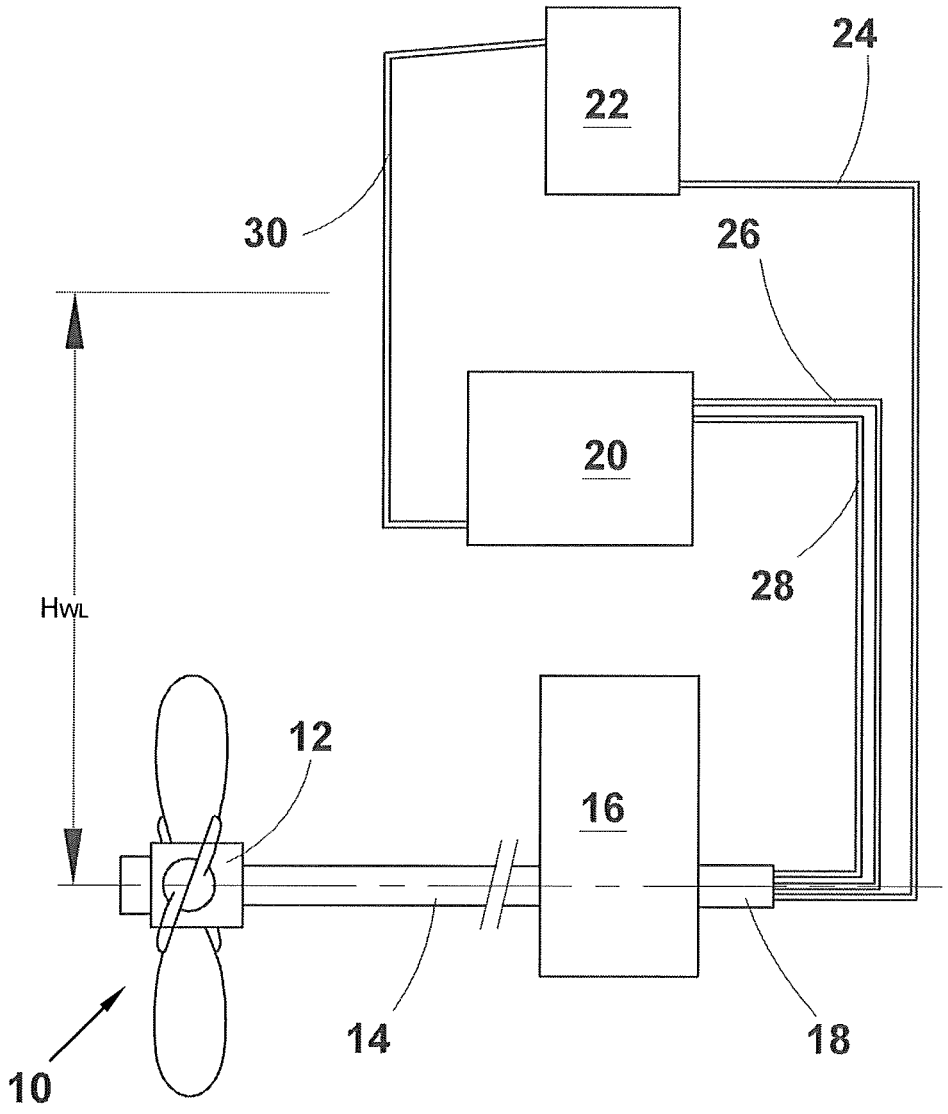
Fig. 1 (Prior Art)
FIG. 1 illustrates schematically an exemplary lubrication and control arrangement of a prior art controllable pitch propeller.
Figure 2:
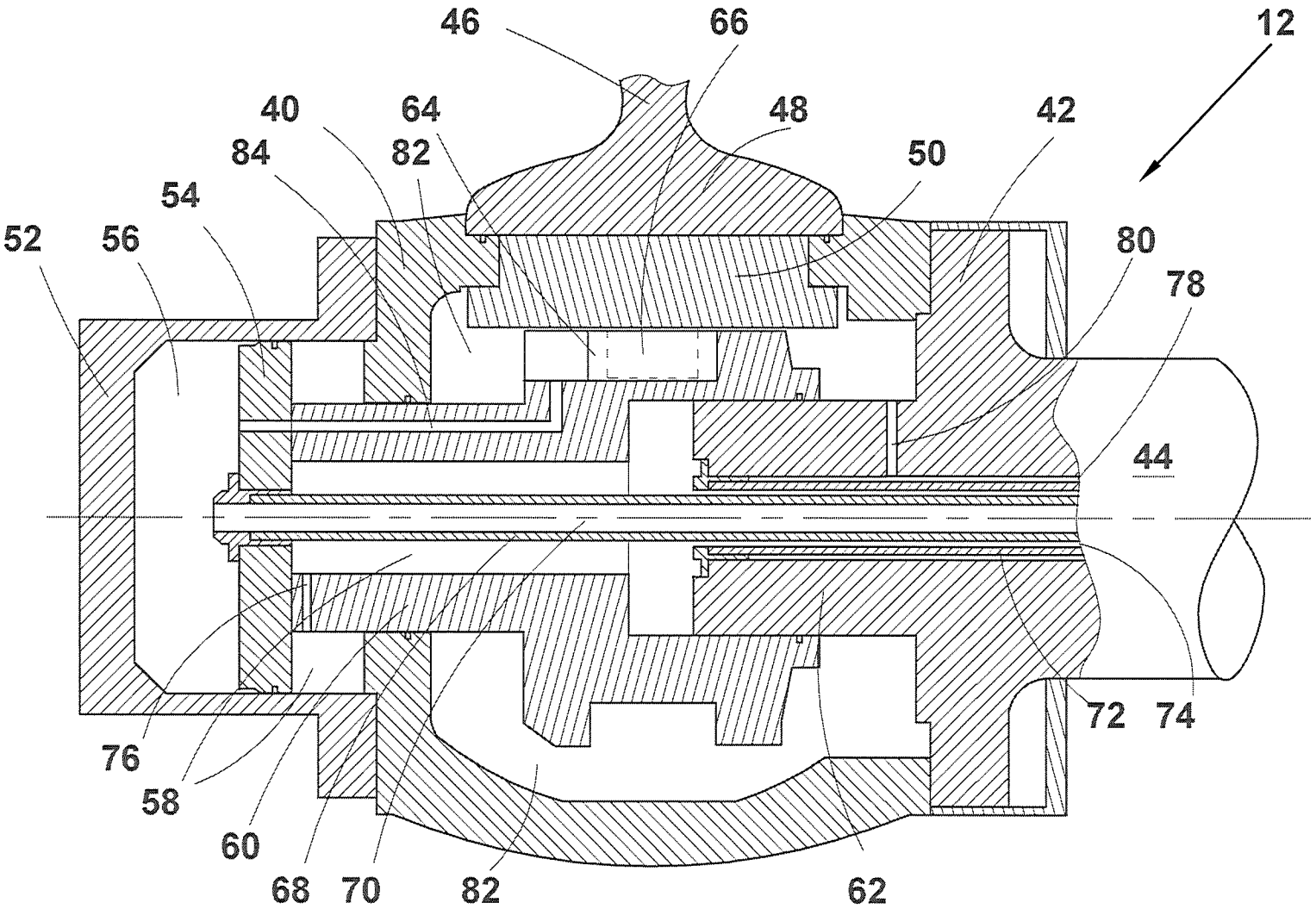
Fig. 2 (Prior Art)
FIG. 2 illustrates schematically a hub of a prior art controllable pitch propeller.

FIG. 1 illustrates a mechanically driven (though also electric drives may be used in connection with the invention) exemplary prior art controllable pitch propeller mainly in view of its control and lubrication arrangement. The arrangement of FIG. 1 comprises a controllable pitch propeller 10 with its hub 12, a shafting 14, a drive means 16 (which is normally a reduction gear or an electric drive motor), an oil distribution box 18, a hydraulic powerpack 20 and an oil tank 22 with appropriate oil pipes connecting the various components to one another as will be explained later on. The hub 12 comprises, among other components, both mechanical and hydraulic means for changing or controlling the pitch of the propeller blades, i.e. for changing the blade angle position between an ahead and an astern positions, as will be explained in more detail in connection with FIG. 2. The shafting 14 comprises a sterntube and a drive shaft. The sterntube is a non-rotary tube arranged to surround the drive shaft, to lead the drive shaft from the drive means through the marine vessel hull to the outside of the vessel and to protect such from any solid objects in the water. The drive shaft is, as will be shown in more detail in FIG. 2, provided with a central hollow interior or bore provided with two tubes inside one another. The tubes extend from the oil distribution box 18 to the hub 12, form three flow paths from the oil distribution box 18 to the hub 12 for providing the hub with both lubricant and oil for controlling the blade angle of the propeller 10 with the hydraulic means for changing the pitch of the propeller blades.

The oil distribution box 18 is arranged, preferably but not necessarily, at the end of the drive shaft at a side of the drive means such that the required connections between the rotary shaft and the rotary tubes therein to stationary oil pipes may be made easily. The oil distribution box 18 connects the above mentioned three flow paths, which rotate with the drive shaft, by means of an oil pipe 24 to the oil tank 22 and two oil pipes 26 and 28 to the hydraulic powerpack 20. The hydraulic powerpack 20 is connected by means of an oil pipe 30 to the oil tank 22 so that enough oil is always at the disposal of the hydraulic powerpack. The hydraulic powerpack 20 includes means for handling the oil used for operating the means for changing the blade angle of the propeller. In other words, the hydraulic powerpack comprises, among other components, hydraulic pump/s for pressurizing the oil, filter/s for keeping the oil clean etc. The hydraulic powerpack is used by a pilot-operated main control valve for operating the hydraulic means in the hub for changing the pitch or the blade angle position between an ahead and an astern position.

FIG. 2 illustrates schematically a hub of a prior art controllable pitch propeller. The hub comprises a hub body 40, which is fastened to a flange 42 arranged at an end of the drive shaft 44. To the hub 12 a plurality of propeller blades 46 has been rotatably arranged by means of attaching each blade 46 via its blade foot 48 to a rotatable crank ring 50 of its own, preferably by means of bolts. The blade foot 48 and/or the crank ring 50 has/have been sealed in relation to the hub body 40 such that oil used for lubricating the interior of the hub, i.e. the mechanical pitch control means, does not leak to the water surrounding the hub, when in operation.

The interior of the hub is provided with the hydraulic means for controlling the pitch or for changing the blade angle of the propeller, i.e. for changing the blade angle position between an ahead and an astern position as was already mentioned in connection with FIG. 1. At an end opposite to the drive shaft 44, the hub 40 is provided with a cap 52 fastened to the hub body 40. The interior of the cap 52 is provided with a piston 54 dividing the cylindrical interior volume of the cap 52 to two chambers, i.e. an astern oil chamber 56 and an ahead oil chamber 58. The piston 54 is fastened to an end of a cylinder yoke 60, which has a few functions. Firstly, it acts as a rod for the piston 54 by being supported and sealed within an opening in the wall of the hub body 40 and on the extension 62 of the drive shaft 44. Secondly, the cylinder yoke 60 includes another part of the ahead oil chamber 58 to which pressurized oil is delivered from the hydraulic powerpack 20 when the propeller blades 46 are turned to an ahead position. And, thirdly the cylinder yoke 60 includes a part of the mechanical means used for controlling the pitch, i.e. for turning the propeller blades 46 between their ahead and astern positions. The mechanical means for controlling the pitch, i.e. the propeller blade turning means, comprises, for each propeller blade 46, a groove arranged in the outer circumference of the cylinder yoke 60, the groove being, preferably, but not necessarily, in a direction perpendicular to the axis of the cylinder yoke 60. The groove is provided with a sliding block 64 having a round hole for housing a pin 66 (shown by broken lines) provided non-concentrically on the interior surface of the crank ring 50. Thus, by moving the piston/cylinder yoke unit in axial direction the sliding block 64 in the groove in the cylinder yoke 60 forces the pin 66 to move and turn the crank ring 50, whereby the blade 46 is turned, as the pin 66 is not located at the center of the crank ring 50 but at a side thereof. Simultaneously, the sliding block 64 also slides in the groove.

The actual operation of the hydraulic means for changing the blade angle of the propeller is based on the pressurized oil provided either in the ahead or in the astern oil chambers via the flow paths arranged in the drive shaft 44. In other words, the drive shaft 44 has a hollow interior provided with two tubes arranged one inside another within the hollow interior of the drive shaft 44. The inner one (68) of the two tubes extends from the oil distribution box 18 to and through the piston 54 to which it has been fastened such that it moves with the piston 54. The interior of the tube 68 forms an astern flow path 70 for the pressurized oil from the hydraulic powerpack 20 via an astern oil pipe 26 and the oil distribution box 18 to the astern oil chamber 56. The outer one 72 of the two tubes within the drive shaft interior forms together with the inner tube 68 an ahead flow path 74 for the pressurized oil from the hydraulic powerpack 20 via an ahead oil pipe 28 and the oil distribution box 18 to the ahead oil chamber 58, i.e. first in the cavity inside the cylinder yoke 60, i.e. inner part of the ahead oil chamber 58, and from there along at least one hole 76 in the cylinder yoke 60 to the outer part of the ahead oil chamber 58. The outer tube 72 extends from the oil distribution box 18 to the opposite end of the drive shaft 44, i.e. to the end of the drive shaft extension 62 within the hub and is attached and sealed thereto. The outer tube 72 forms with the surface of the hollow interior of the drive shaft 44 a lubricant path 78 for the lubricant from the oil tank 22 along oil pipe 24, the oil distribution box 18 and at least one first lubricant passage 80 arranged in the shaft extension 62 to the lubricant chamber 82 where the mechanical means for controlling the pitch, i.e. turning the propeller blades, are located. The first lubricant passage 80 opens in the lubricant chamber 82 in its innermost location so that any gas present (for any reason, including the assembly) in the interior of the hub is able to escape when the hub is rotated. In other words, when the hub is rotating any gas in the hub collects against the shaft extension at the innermost open part of the hub, as the oil being heavier occupies the rest of the hub interior cavity. In order for the lubrication to work properly the oil tank 22 is located well above the waterline of the fully loaded marine vessel (shown in FIG. 1). With this arrangement the hydrostatic pressure within the lubricant chamber 82 is maintained higher than outside the hub 12, whereby, in case of any leakage, the risk of water entering the lubricant chamber 82 is significantly reduced.

Figure 3A:
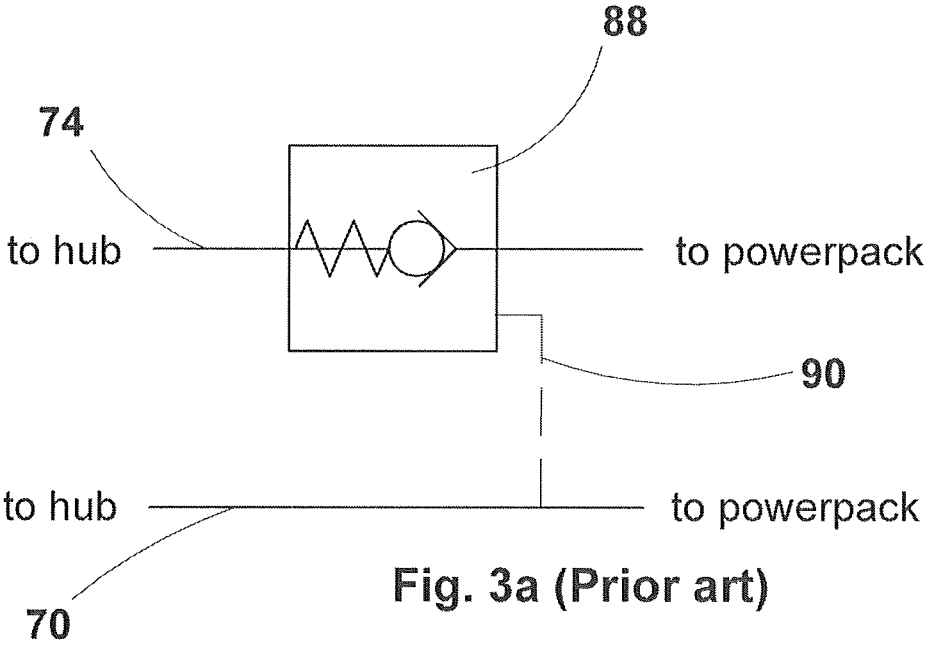
Fig. 3a (Prior art)
FIGS. 3*a*-3*c* illustrate schematically a few blocking valve options to be arranged in connection with the hub of a prior art controllable pitch propeller.
Figure 3B:
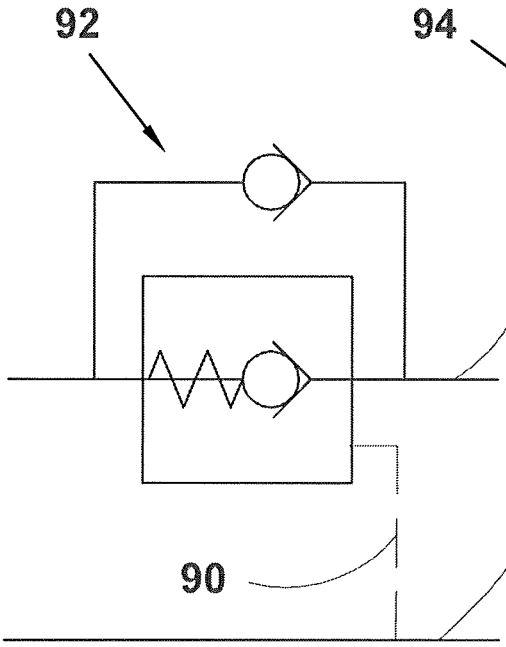
Fig. 3b (Prior art)
Figure 3C:
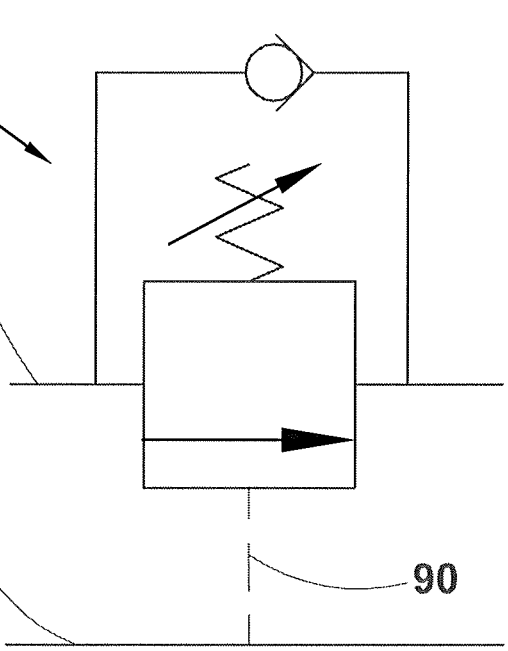
Fig. 3c (Prior art)

Prior art FIGS. 3*a*-3*c* illustrate schematically a few alternative valve arrangements used for blocking the oil flow from the ahead oil chamber to the hydraulic powerpack, i.e. for holding the pitch of the propelled constant. In the introductory part of this specification it was already mentioned that, as connections between fixed and rotating oil paths in the oil distribution box are, by nature, leaking, the oil path between the ahead oil chamber and the oil distribution box has to be provided with a blocking valve. In other words, the blocking valve has to be arranged in the rotary shaft in connection with the central tubes therein. The blocking valve by preventing oil flow from the ahead oil chamber to the oil distribution box locks the blades of the propeller at their desired pitch. FIG. 3*a* comprises a valve means 88 (here a certain type of a pilot-operated non-return valve) arranged in the ahead flow path 74, the valve means 88 allowing oil flow towards the hub, i.e. to the ahead oil chamber 58 of the hub, and controlling oil flow in the opposite direction from the ahead oil chamber 58 back in the direction of the hydraulic powerpack 20, in practice blocking the oil flow, as long as the pressure in the astern flow path 70 is below a predetermined value (for example between about 3 to 80 bar). In other words, pilot line 90 introduces the pressure of the astern flow path 70 to the valve means 88 such that when the pressure in the astern flow path 70 is increased to the predetermined value, the valve means 88 open, and oil from the ahead oil chamber may flow to the hydraulic powerpack. Naturally, this also means that the pitch of the propeller starts changing to astern direction. As to the predetermined pressure it is a function of a number of variables, whereby the applicable range thereof is quite wide. The variables include, for instance, the spring used in the blocking valve (in principle fixed, but may be decided when choosing or designing the valve), the pilot ratio of the valve (area on to which the astern pressure acts divided by the area on to which the ahead chamber pressure acts) (in principle fixed, but may be decided when choosing or designing the valve), and the ahead chamber pressure (determined by the force the propeller blades exert on the moving cylinder yoke and determined by the propeller blade design and the actual operating conditions).

The described arrangement works such that when the marine vessel is moving or sailing ahead both the pilot-operated main control valve in connection with the hydraulic powerpack and the valve means 88 between the ahead oil chamber 58 and the oil distribution box have closed the ahead flow path 74, i.e. preventing the ahead oil chamber 58 from emptying and locking the propeller blades at their desired position or pitch. When it is desired that the propeller pitch is adjusted to astern direction, the pilot-operated main control valve is moved to astern position, whereby the hydraulic powerpack pressure enters the astern flow path 70 and acts in the pilot line 90 of the valve means 88. The hydraulic powerpack pressure exceeds the opening pressure of the valve means 88 thereby opening the valve means 88 such that oil may flow from the ahead oil chamber to the oil distribution box and further to the hydraulic powerpack, whereby the blades of the propeller are capable of turning in astern direction.

FIG. 3*b* illustrates another alternative for the valve means working in the same manner as that of FIG. 3*a*. Here the valve means 92 (another type of a pilot-operated non-return valve) allow free flow along the ahead flow path 74 towards the ahead oil chamber to the left, whereas the flow in the opposite direction is blocked, until the pressure in the astern flow path 74 exceeds the predetermined value opening the valve means 92.

FIG. 3*c* illustrates yet another alternative for the valve means working in the same manner as that of FIG. 3*a*. Here the valve means 94 (a type of a counterbalance valve) allow free flow along the ahead flow path 74 towards the ahead oil chamber to the left, whereas the flow in the opposite direction is blocked, until the pressure in the astern flow path 74 exceeds the predetermined value opening the valve means 94.

The astern flow path 70 may also be provided with blocking valve means similar in both construction and operation to those discussed in FIGS. 3*a*-3*c*.

The above description contains the basic features and properties of the control and lubrication arrangement of a controlled pitch propeller. However, in order to work in a reliable manner the hub, and especially its lubricant chamber 82 is provided with means for circulating the lubricant. The oil circulation is needed as a significant amount of gas is always collected in the lubricant chamber 82 when assembling and installing the hub. For arranging the gas removal by means of the oil circulation, the piston 54 and the cylinder yoke 60 are provided with at least one oil circulation channel 84 (see FIG. 2) from the astern oil chamber 56, or from the flow path 70 leading thereto, to the lubricant chamber 82. The lubricant circulation functions in the controlled pitch propeller hubs of prior art only when the astern oil chamber is pressurized in natural manner, i.e. when the travel direction of the marine vessel is changed from the ahead direction to astern direction or the speed of the marine vessel is decelerated by the propeller. In such a case the pressurized oil flows along oil circulation channel/s 84 to the lubricant chamber 82 and via the first lubricant passage 80 to the lubricant flow path 78 taking the air out of the lubricant chamber 82 in the manner discussed earlier. The operation of the prior art lubrication arrangement is discussed in more detail in the following.

When the operator of the marine vessel wishes to adjust the blade angle of the propeller to ahead direction he/she moves the pilot-operated main control valve in connection with the hydraulic powerpack to open the astern flow path 70 and to direct full oil pressure (for example 10-30 bar depending on the pressure in the ahead oil chamber caused by the external load on the propeller blades) to the ahead flow path 74. Then, the pressure in the ahead flow path 74 moves the cylinder yoke 60 to the left forcing oil from the astern oil chamber 56 to the hydraulic powerpack 20, and turning the propeller blades. As to the oil circulation from the astern oil chamber 56 to the lubricant chamber 82 and further to the tank 22, it depends on the possible counter-pressure in the hydraulic powerpack.

When the operator of the marine vessel wishes to adjust the blade angle of the propeller to astern direction he/she moves the pilot-operated main control valve in connection with the hydraulic powerpack to open the ahead flow path 74 and to direct full oil pressure to the astern flow path 70. Then, the pressure in the astern flow path 70 exceeds the opening pressure of the valve means 88, the valve means 88 open allowing oil flow from the ahead oil chamber 58 to the hydraulic powerpack 20, and the cylinder yoke 60 to move and turn the propeller blades. As to the oil circulation from the astern oil chamber 56 to the lubricant chamber 82 and further to the tank 22, it continues without interruption. In other words, the only time period when the lubricant circulation is, in fact, really operating is when the propeller blades are turning in astern direction, i.e. the pilot-operated main control valve is moved to astern position. Thus, as soon as the desired propeller blade position is reached, and the pilot-operated main control valve is moved to neutral position, the lubricant circulation is ceased.

When, in prior art, the pilot-operated main control valve is in neutral position, it blocks all connections whereby there is no additional pressure in the astern oil chamber, and as a consequence, there is no forced lubricant circulation via the lubricant chamber. Thus, in practice, the lubricant circulates only a small portion of the time the propeller is running, as the sailing in ahead or astern direction, i.e. when the pilot-operated valve is in neutral position and the propeller blades locked in desired position, takes normally more than 90% of the time the propeller is running. Thus the lubricant circulation functions, at most, less than 10% of the time the propeller is running.

However, lately the environmental regulations have changed such that the oil used in the controlled pitch propeller hubs has to be environmentally acceptable. This far the oils have been mineral oils, but as they cause severe environmental problems when entering seawater in case of leakage, the environmental requirements dictate that less harmful oils have to be used. Environmentally acceptable lubrication oils, i.e. lubricants, are available, and their lubrication properties are as good as the mineral oils. However, they have a severe drawback, as they degrade very easily when getting into contact with water. Such degradation of lubricant may lead to wear and damage of the components requiring lubrication in the hub. This means, in practice, that the prior art occasional lubricant circulation described above cannot be considered sufficient, but the oil has to be circulated, in practice, nearly continuously such that any water in the lubricant may be detected and removed. Therefore, the lubricant circulation system has to be reconsidered.

Figure 4:
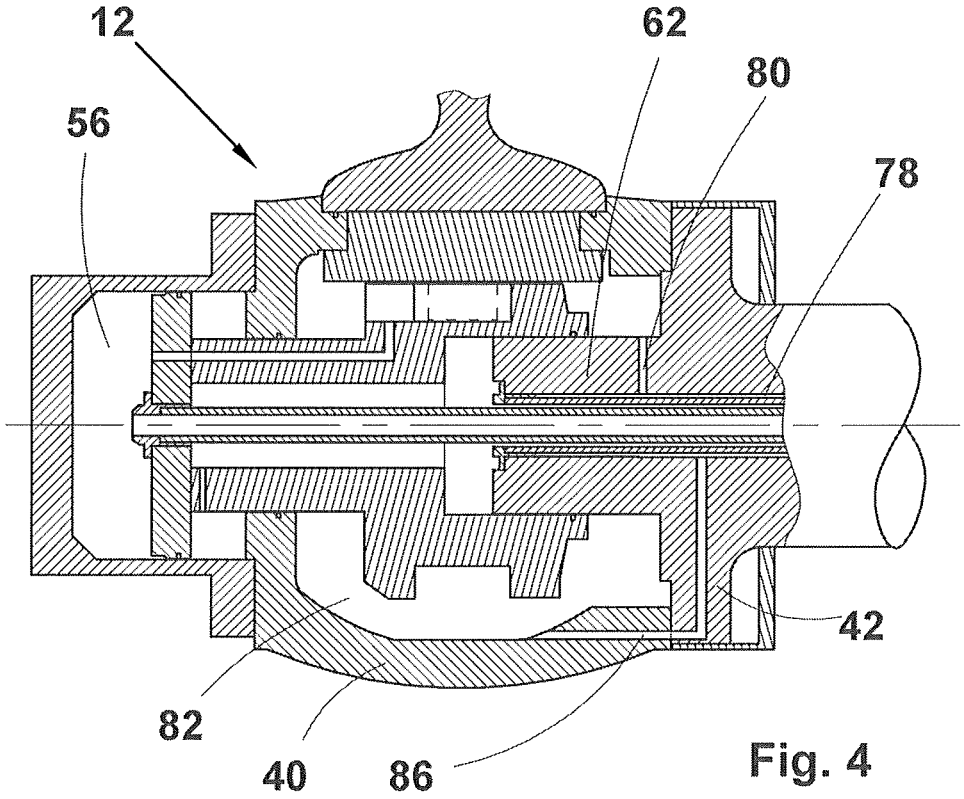
FIG. 4 illustrates schematically a hub of a controllable pitch propeller in accordance with a preferred embodiment of the present invention.

A first improvement in the lubricant circulation is the provision of the lubricant chamber 82 with not only one route, but two different routes for the circulating oil. A first route, i.e. the first lubricant passage/s 80, known from prior art, taking oil from the surface of the drive shaft extension 62 to the lubricant path 78, and a second, novel route from the nearhood of the inner surface of the hub body 40 along at least one second lubricant passage 86 in the hub body 40 and in the drive shaft flange 42 to the lubricant path 78 as shown in FIG. 4. Now, when the hub is in use, i.e. rotating, the oil in the lubrication chamber is divided such that any light gas-containing oil collects at the surface of the drive shaft extension and escapes via the first lubricant passage/s 80, whereas the heavy, possibly water-containing, oil collects, due to centrifugal force, against the inner surface of the hub body, i.e. to the outer circumference of the lubricant chamber 82, and escapes via the second lubricant passage/s 86. Both circulated oil fractions are taken along flow path 78 to the oil tank 22 for further treatment. As to dimensioning (length and diameter) the first and the second lubricant passages 80 and 86, they may be, preferably but not necessarily, balanced such that the flow resistances or restrictions of the passages are substantially equal, whereby both gas-containing and water-containing oil may be removed from the hub.

A second improvement in the lubricant circulation is, unlike in prior art arrangements, in accordance with the present invention, the maintenance of a pressure difference between the astern oil chamber 56 and the lubricant chamber 82 at least when sailing ahead, and preferably when sailing astern, too, with the propeller blades locked in desired position. As a marine vessel is sailing ahead most (normally more than 90%) of the time of its operation, it is crucial for the quality of the oil that the lubricant is circulated when sailing ahead. However, the pressure is reduced when compared to the pressure used for controlling the pitch of the propeller. In other words, the pressure of the oil in the astern oil chamber 56 is adjusted to a predetermined value (for instance between about 1 and 7 bar) above the hydrostatic pressure in the lubricant chamber 82 and below the predetermined pressure needed for opening the valve means 88, whereby the oil flows from the astern oil chamber 56 to the lubricant chamber 82, and therefrom along lubricant flow path 78 to the oil tank 22.

Figure 5:
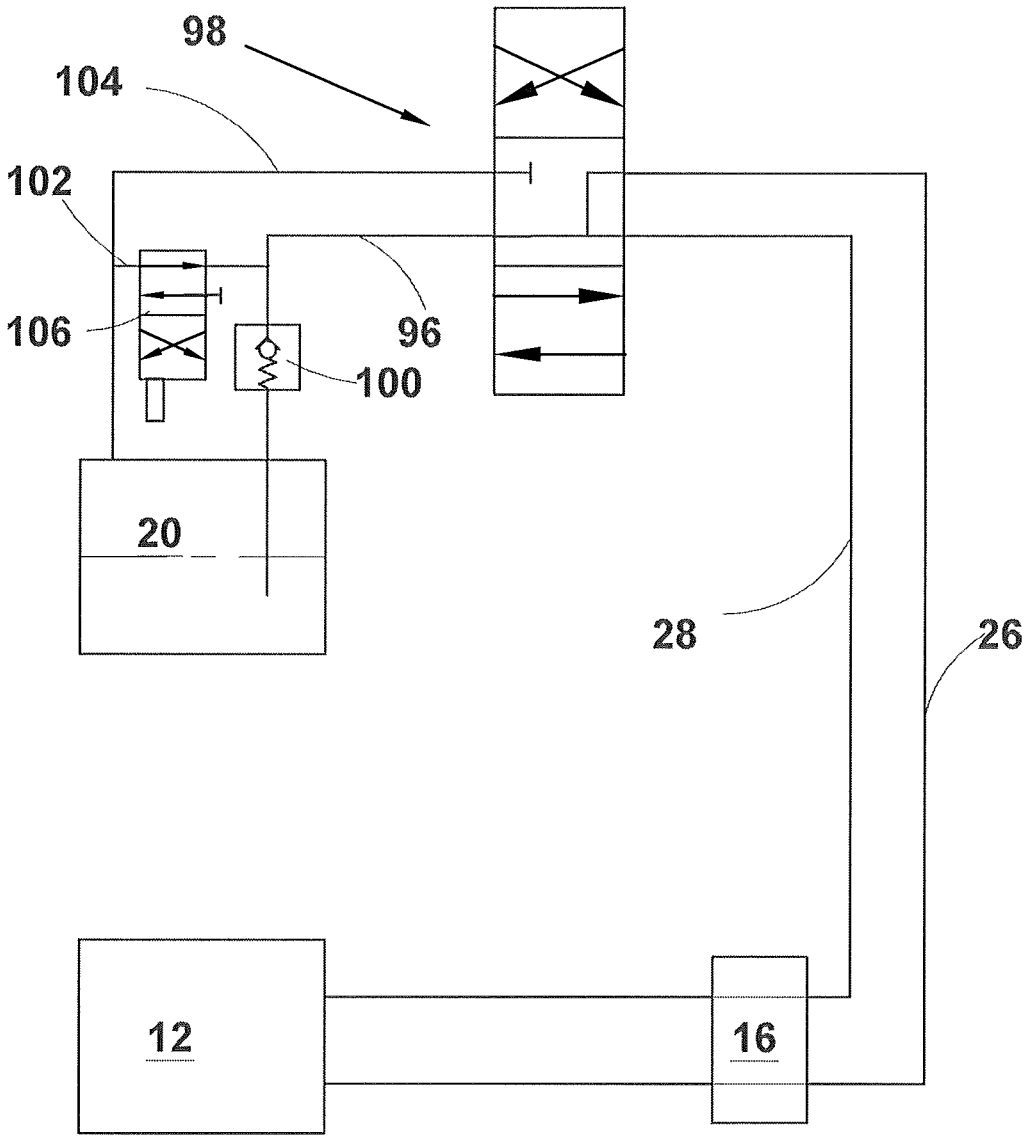
FIG. 5 illustrates schematically a way of arranging lubricant circulation in the lubricant chamber in accordance with a first preferred embodiment of the present invention.

There are several optional ways of arranging the pressure difference and resulting oil flow through the astern flow chamber to the lubricant chamber for ensuring lubricant circulation. A way of arranging the lubricant circulation in accordance with a first preferred embodiment of the present invention is discussed in more detail in FIG. 5. It has been taught in FIG. 5 that the return oil flow path 96 between the pilot-operated main control valve 98 and the hydraulic powerpack 20 is provided with a non-return valve 100, which opens by means of a desired pressure in the return oil flow path 96 to the hydraulic powerpack 20. Additionally, a flow connection 102 has been arranged between the pressure oil path 104 and the return oil path 96, the flow connection 102 being provided with a control valve 106, which is arranged to allow or to block pressurized oil flow to the return oil path 96. The described arrangement functions such that in the neutral position of the pilot-operated main control valve 98 the flow connection 102 between the pressure oil path 104 and the return oil path 96 via control valve 106 is opened, for instance such that the pilot-operated main control valve 98 instructs the control valve 106 to open, and the pilot-operated main control valve 98 connects at least the astern oil pipe 26, and possibly also the ahead oil pipe 28, to the return oil path 96. Now that the non-return valve 100 is arranged to open by a certain pressure, for instance 2 bar or 4 bar, oil at said pressure affects also in the astern oil chamber in the hub 12 ensuring lubricant circulation into the lubricant chamber and further into the oil tank (not shown). The non-return valve 100 is chosen such that an adequate oil pressure resulting in oil circulation, of the order of 2-20 l/min, in the lubricant chamber is accomplished. Here, the return path for the lubricant to the oil tank has not been shown.

When the pilot-operated main control valve 98 is moved to its ahead position, the flow connection between the pressure oil path 104 and the return oil path 96 is closed, for instance such that the pilot-operated main control valve 98 instructs the control valve 106 to close, the pressure oil path 104 is connected to the ahead oil pipe 28, and the astern oil pipe 26 to the return oil path 96. Now that the return oil path 96 is provided with the non-return valve 100, a certain increased pressure is maintained in the astern oil chamber ensuring lubricant circulation into the lubricant chamber and further into the oil tank.

When the pilot-operated main control valve 98 is moved to its astern position, the flow connection between the pressure oil path 104 and the return oil path 96 is closed, for instance such that the pilot-operated main control valve 98 instructs the control valve 106 to close, the pressure oil path 104 is connected to the astern oil pipe 26, and the ahead oil pipe 28 to the return oil path 96. Now, in the astern oil pipe 26 and in the astern oil chamber there is, naturally, an increased pressure ensuring lubricant circulation into the lubricant chamber and further into the oil tank.

Figure 6:
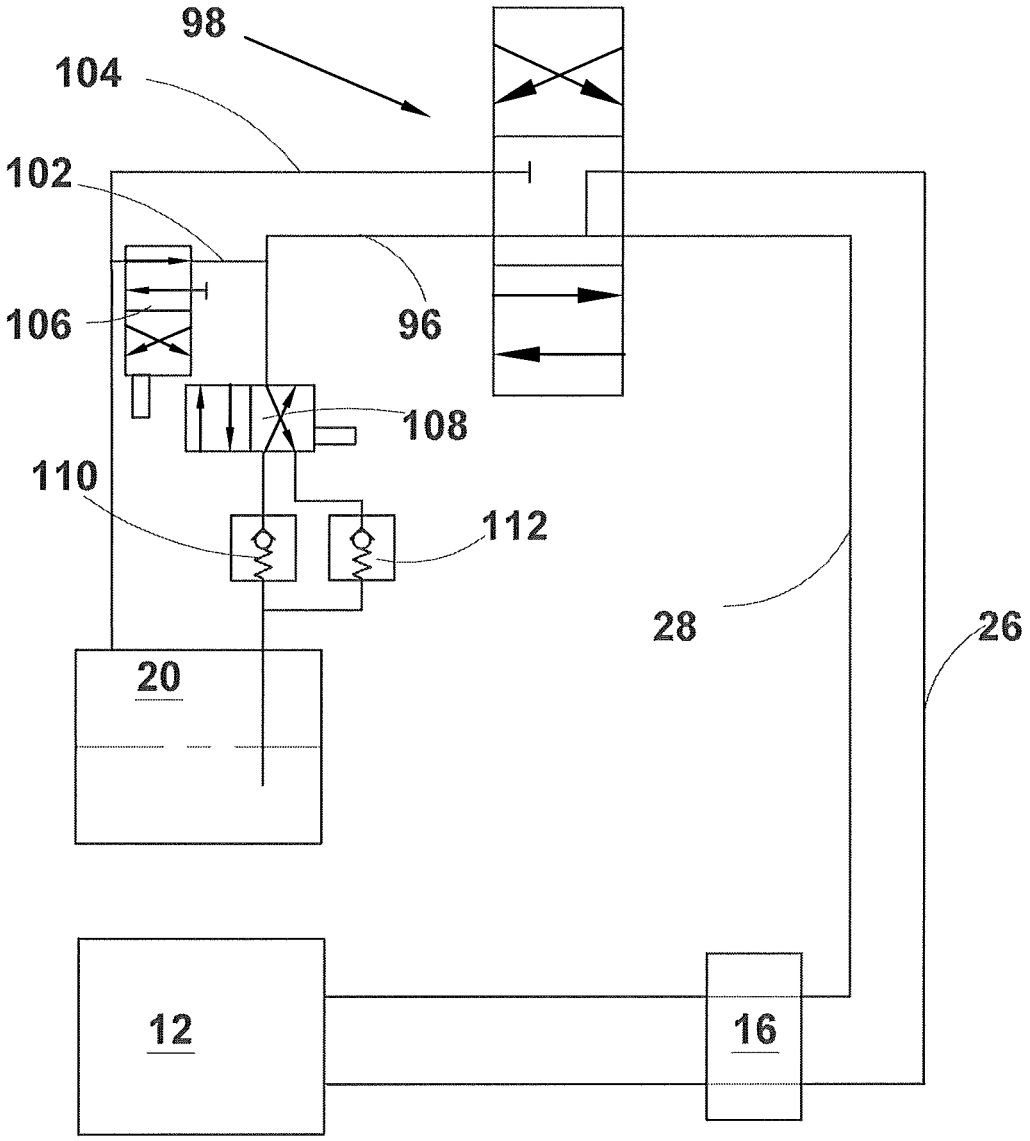
FIG. 6 illustrates schematically another way of arranging lubricant circulation in the lubricant chamber in accordance with a second preferred embodiment of the present invention.

Another way of arranging the lubricant circulation in accordance with a second preferred embodiment of the present invention is discussed in more detail in FIG. 6. It has been taught in FIG. 6 that the return oil path 96 between the pilot-operated main control valve 98 and the hydraulic powerpack 20 is provided with a pilot-operated control valve 108 and two non-return valves 110 and 112, which open by means of desired pressures in the return oil flow path 96. For instance, the non-return valve 110 may be arranged to open with a pressure of 2 bar and the non-return valve 112 with a pressure of 4 bar. Additionally, like in the embodiment of FIG. 5, a flow connection 102 has been arranged between the pressure oil path 104 and the return oil path 96, the flow connection 102 being provided with a control valve 106. The described arrangement functions such that in the neutral position of the pilot-operated main control valve 98 (shown in FIG. 6) the flow connection 102 between the pressure oil path 104 and the return oil path 96 is opened, for instance such that the pilot-operated main control valve 98 instructs the control valve 106 to open, and the pilot-operated main control valve 98 connects at least the astern oil pipe 26, possibly also the ahead oil pipe 28, to the return oil path 96. The pilot-operated control valve 108 is in a position that connects the return oil path 96 to the non-return valve 112, i.e. to the valve opening at a higher pressure than the other counter-pressure valve 110. Now that the non-return valve 112 is arranged to open by a certain pressure, for instance 4 bar, the oil pressure affects also in the astern oil chamber in the hub 12 ensuring lubricant circulation into the lubricant chamber and further into the oil tank. The non-return valve 112 is chosen such that an adequate oil pressure resulting in oil circulation, of the order of 2-20 l/min, in the lubricant chamber is accomplished. Here, the return path for the lubricant to the oil tank has not been shown.

When the pilot-operated main control valve 98 is moved to its ahead position, the flow connection between the pressure oil path 104 and the return oil path 96 via control valve 106 is closed, for instance such that the pilot-operated main control valve 98 instructs the control valve 106 to close, the pressure oil path 104 is connected to the ahead oil pipe 28, and the astern oil pipe 26 to the return oil path 96. Here, the pilot-operated control valve 108 may be chosen, as desired, to connect the return oil path 96 to either the non-return valve 112, i.e. the one having a higher opening pressure, or the non-return valve 110, i.e. the one having a lower opening pressure. Now that the return oil path 96 is provided with the non-return valves 110 or 112 a certain increased pressure is maintained in the astern oil chamber ensuring lubricant circulation into the lubricant chamber and further into the oil tank.

When the pilot-operated main control valve 98 is moved to its astern position, the flow connection between the pressure oil path 104 and the return oil path 96 via the control valve 106 is closed, for instance such that the pilot-operated main control valve 98 instructs the control valve 106 to close, the pressure oil path 104 is connected to the astern oil pipe 26, and the ahead oil pipe 28 to the return oil path 96. Now, as in the astern oil pipe 26 and in the astern oil chamber there is, naturally, an increased pressure ensuring lubricant circulation into the lubricant chamber and further into the oil tank, the pilot-operated control valve 108 may be moved to the other position connecting the return oil path 96 to the non-return valve 110 having a lower opening pressure, whereby the energy needed for returning the oil from the ahead oil chamber is reduced compared to the embodiment of FIG. 5.

Figure 7:
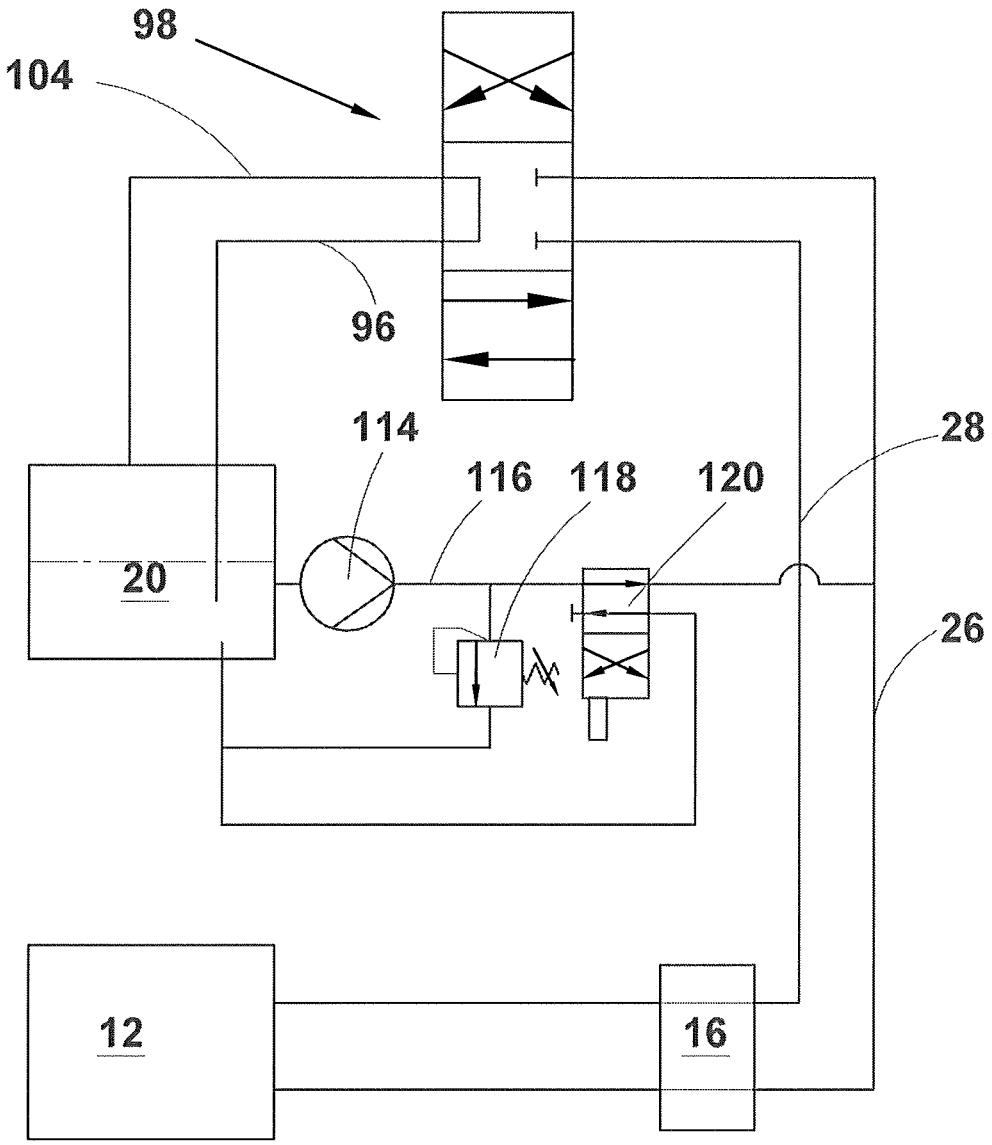
FIG. 7 illustrates schematically yet another way of arranging lubricant circulation in the lubricant chamber in accordance with a third preferred embodiment of the present invention.

Yet another way of arranging the lubricant circulation in accordance with a third preferred embodiment of the present invention is discussed in more detail in FIG. 7. In the third embodiment, a separate hydraulic pump 114 is arranged in or in connection with the hydraulic powerpack 20. The hydraulic pump 114 is connected by means of an oil path 116 for pressurized oil to the astern oil pipe 26 such that the oil pressure is limited by means of some kind of a pressure-reduction valve 118 arranged into a return flow path between the oil path 116 and the hydraulic powerpack. In the illustrated arrangement the hydraulic pump 114 delivers oil continuously to the astern oil pipe 26 such that the pressure of the oil entering the astern oil pipe 26 is regulated by the pressure reduction valve 118. The delivery of oil to the astern oil pipe 26 may take place irrespective of the position of the pilot-operated main control valve 98. However, a more preferred option would be to arrange some kind of a control valve 120 in the oil path 16 between the hydraulic pump 114 and the astern oil pipe 26, for instance the control valve 120 receiving its instructions from the position of the pilot-operated main control valve 98. Naturally, when the pilot-operated main control valve 98 is in astern position a higher pressure is taken to the astern oil chamber from the pressure oil path 104, whereby no flow is needed from the oil path 116. Also, in the ahead position of the pilot-operated main control valve 98, when the astern oil pipe 26 is returning oil from the astern oil chamber there is no need for the oil delivery by means of the hydraulic pump 114. In the latter case, however, if lubricant circulation in the lubricant chamber is desired, it would be preferable to arrange a non-return valve in the return oil path as discussed in connection with the embodiments of FIGS. 5 and 6. Thus, it would appear advantageous if the pilot-operated main control valve 98 was made to instruct the optional control valve 120 to close or the hydraulic pump 114 to stop working whenever the pilot-operated main control valve 98 is shifted from its neutral position.

It has to be understood that the discussion of certain pressure values is only exemplary, as the pressure values cannot be decided alone but always together with the flow resistances in the various flow paths containing possible throttling orifices, the oil viscosity and the desired volume flow. Also the positioning of the hydraulic powerpack and the oil tank in relation to the vertical position of the waterline and the hub have an effect on the required pressure values. For instance, the pressure difference between the astern oil chamber 56 and the lubricant chamber 82 together with the flow resistance in the oil circulation channel/s 84 and the oil viscosity define the amount of circulating oil flow. If desired (each) oil circulation channel 84 may be provided with an orifice (of its own) of desired size to control the circulation of oil. In such a case the rest of (each) oil circulation channel 84 may be made wider, whereby its flow resistance may be neglected.

It should be understood, too, that the present invention, i.e. arranging, at least when the propeller blades are locked in a desired position, a pressure difference between the astern oil chamber and the lubricant chamber for circulating lubricant from the astern oil chamber via the lubricant chamber to the oil tank, and thereby a continuous flow from the astern oil chamber to the lubricant chamber, may also be applied intermittently. In other words such that, for instance, the oil circulation is coupled 'on' for a certain period of time (for instance 1 minute, 2 minutes or 5 minutes) and thereafter 'off' for another period of time (for instance 30 seconds, 1 minute, 2 minutes or 4 minutes), and then again 'on'. By doing this, on the one hand some pumping energy is saved, but, on the other hand, some additional instrumentation is needed.

It should also be understood that the lubrication arrangement discussed above is not only applicable in new constructions, but also existing hub installations may be easily updated to include the novel lubrication arrangement. The only thing that needs to be done is the addition of the second lubricant passage/s in the hub and the installation of required valve/s, preferably but not necessarily, in connection with the oil distribution box or the hydraulic powerpack. In case the existing hub has no oil circulation, the required oil passage/s need to be drilled.

It should further be understood that the above is only an exemplary description of a novel and inventive method of lubricating a controllable pitch propeller arrangement of a marine vessel and a lubrication arrangement therefor. It should be understood that the above description discusses only a few preferred embodiments of the present invention without any purpose of limiting the invention to the discussed embodiments and their details only. In other words, it is obvious that there are numerous alternatives for arranging the hydraulic elements of the arrangement, whereby it is clear that the invention is not limited to the named elements, like for instance the valve types, discussed in the specification, but each and every element or group of elements performing the claimed function are covered by the claims. For instance the various flow paths in the drive shaft may not only be arranged by means of the two concentric tubes as discussed above, but the hollow interior of the drive shaft may be provided with three pipes leading from the oil distribution box to the appropriate position within the hub to be connected to the various oil chambers or the shaft may be provided with (at least) three bores extending from the oil distribution box to the appropriate position within the hub to be connected to the various oil chambers. Thus the above specification should not be understood as limiting the invention by any means but the entire scope of the invention is defined by the appended claims only. From the above description it should be understood that separate features of the invention may be used in connection with other separate features even if such a combination has not been specifically discussed in the description or shown in the drawings.

The invention claimed is:

1. A method of lubricating a controllable pitch propeller arrangement of a marine vessel, the controllable pitch propeller arrangement having a hub, a drive shaft, a drive, an oil distribution box, a hydraulic powerpack and an oil tank, wherein the hub has a number of propeller blades and mechanical and hydraulic controllers for controlling pitch of the propeller blades, the mechanical controller being arranged in a lubricant chamber the hydraulic controller including an astern oil chamber and an ahead oil chamber;

the hub being attached to a first end of a drive shaft;

the second end of the drive shaft being coupled to the drive;

the drive shaft having three oil paths, an astern flow path for connecting the astern oil chamber to the hydraulic powerpack via the oil distribution box and an oil pipe, an ahead flow path for connecting the ahead oil chamber to the hydraulic powerpack via the oil distribution box and an oil pipe and a lubricant path for connecting the lubricant chamber to the oil tank via the oil distribution box and an oil pipe; and the lubricant chamber being connected by at least one first lubricant passage to the lubricant path, the method comprising:

connecting the astern oil chamber or the astern flow path leading thereto by at least one oil circulation channel to the lubricant chamber; and arranging, at least when the propeller blades are locked in a desired position, a pressure difference between the astern oil chamber and the lubricant chamber for circulating lubricant from the hydraulic powerpack via the oil distribution box to the astern oil chamber and via the lubricant chamber to the oil tank.

2. The method as recited in claim 1, comprising:

keeping the astern oil chamber in flow communication with a source of pressurized oil.

3. The method as recited in claim 2, comprising:

regulating oil pressure between the source of pressurized oil and the astern oil chamber to a value below the predetermined value.

4. The method as recited in claim 2, wherein a the source of pressurized oil is one of the hydraulic powerpack and a separate hydraulic pump.

5. The method as recited in claim 1, comprising:

providing the hub with at least one second lubricant passage for removing water-containing oil from the lubricant chamber.

6. The method as recited in claim 1, comprising:

operating a valve in the ahead flow path between the hydraulic powerpack and the ahead oil chamber for keeping the ahead flow path closed until oil pressure in the astern flow path exceeds a predetermined value.

7. The method as recited in claim 1, comprising:

applying a hydrostatic pressure in the lubricant chamber, the pressure in the astern oil chamber exceeding the hydrostatic pressure in the lubricant chamber.

8. The method as recited in claim 1, comprising:

providing the arrangement with a pilot-operated main control valve for controlling operation of the controllable pitch propeller, the pilot-operated main control valve having an ahead position, an astern position and a neutral position.

9. The method as recited in claim 8, comprising:

providing the hydraulic powerpack with a pressure oil path and a return oil path connected to the pilot-operated main control valve; and providing a flow connection between the pressure oil path and the return oil path.

10. The method as recited in claim 9, comprising:

operating a counter-pressure valve in the return oil path between the powerpack and the flow connection for ensuring in the astern oil chamber a pressure exceeding the hydrostatic pressure in the lubricant chamber.

11. The method as recited in claim 10, comprising:

comprising two counter-pressure valves configured as a first counter-pressure valve and a second counter-pressure valve, in parallel in the return oil path and a pilot-operated control valve in the return oil path between the flow connection and the counter-pressure valves such that in one position of the pilot-operated control valve it connects the return oil path via a first counter-pressure valve and in another position of the pilot-operated control valve it connects the return oil path via a second counter-pressure valve to the hydraulic powerpack, the counter-pressure valves having different opening pressures.

12. The method as recited in claim 8, comprising:

connecting, in the neutral position of the pilot-operated main control valve, the return oil path in flow communication with at least the astern oil chamber.

13. The method as recited in claim 8, wherein depending on the position of the pilot-operated main control valve, pressurizing oil by the hydraulic powerpack or means in flow communication therewith to two different pressures which include a higher pressure and a lower pressure, whereby the higher pressure is in use when both the pitch of the propeller is controlled and the lubricant is circulated, and the lower pressure is in use when only the lubricant is circulated.

14. A lubrication arrangement for a controllable pitch propeller arrangement of a marine vessel, the controllable pitch propeller arrangement comprising:

a hub;

a drive shaft;

a drive means;

an oil distribution box;

a hydraulic powerpack and an oil tank, the hub having a number of propeller blades; and mechanical and hydraulic control means for controlling pitch of the propeller blades, the mechanical control means being arranged in a lubricant chamber, the hydraulic control means including an astern oil chamber and an ahead oil chamber;

the hub being attached to a first end of a drive shaft, with a second end of the drive shaft being coupled to the drive means, the drive shaft having three flow paths which include: an astern flow path for connecting the astern oil chamber to the hydraulic powerpack via the oil distribution box and an oil pipe, an ahead flow path for connecting the ahead oil chamber to the hydraulic powerpack via the oil distribution box and an oil pipe, and a lubricant path for connecting the lubricant chamber to the oil tank via the oil distribution box and an oil pipe; and the lubricant chamber being connected by at least one first lubricant passage to the lubricant path, wherein the astern oil chamber or the astern flow path leading thereto is connected by at least one oil circulation channel to the lubricant chamber, and a source of pressurized oil is arranged, at least when the propeller blades are locked in a desired position, in flow communication with the astern oil chamber, and through the at least one oil circulation channel, in flow communication with the lubricant chamber.

15. The lubrication arrangement as recited in claim 14, wherein the lubricant chamber comprises:

an outer circumference and at least one second lubricant passage initiating from the outer circumference and terminating to the lubricant path.

16. The lubrication arrangement as recited in claim 14, wherein the source of pressurized oil is one of the hydraulic powerpack and a separate hydraulic pump.

17. The lubrication arrangement as recited in claim 16, comprising:

means for regulating pressure downstream of the separate hydraulic pump.

18. The lubrication arrangement as recited in claim 14, wherein the hydraulic powerpack is connected by a pressure oil path and a return oil path to a pilot-operated main control valve for controlling operation of the controllable pitch propeller, the pilot-operated main control valve having an ahead position, an astern position and a neutral position.

19. The lubrication arrangement as recited in claim 18, comprising:

a flow connection arranged between the pressure oil path and the return oil path.

20. The lubrication arrangement as recited in claim 19, comprising:

a counter-pressure valve in the return oil between the powerpack and the flow connection.

21. The lubrication arrangement as recited in claim 19, comprising:

two counter-pressure valves which include a first counter-pressure valve and a second counter-pressure valve, arranged in parallel in the return oil path and a pilot-operated control valve arranged in the return oil path between the pilot-operated valve and the counter-pressure valves such that in one position of the pilot-operated control valve it connects the return oil path via a first counter-pressure valve and in another position of the pilot-operated control valve it connects the return oil path via a second counter-pressure valve to the hydraulic powerpack, the counter-pressure valves being configured to have different opening pressures.

22. The lubrication arrangement as recited in claim 18, wherein in the neutral position of the pilot-operated main control valve, the return oil path is arranged in flow communication with at least the astern oil chamber.

* * * * *